US008967589B2

(12) United States Patent
Wood et al.

(10) Patent No.: US 8,967,589 B2
(45) Date of Patent: Mar. 3, 2015

(54) SEAL

(75) Inventors: Carl Richard Wood, Alford (GB); Runi Djurhuus Joensen, Westhill (GB); George Senkbeil, Westhill (GB)

(73) Assignee: National Oilwell Varco UK Limited, Audenshaw (GB)

( * ) Notice: Subject to any disclaimer, the term of this patent is extended or adjusted under 35 U.S.C. 154(b) by 0 days.

(21) Appl. No.: 13/454,179

(22) Filed: Apr. 24, 2012

(65) Prior Publication Data

US 2013/0099449 A1 Apr. 25, 2013

(30) Foreign Application Priority Data

May 5, 2011 (GB) ..... 1107459.8

(51) Int. Cl.
*E21B 33/06* (2006.01)
*E21B 33/00* (2006.01)
*E21B 33/072* (2006.01)

(52) U.S. Cl.
CPC ..... *E21B 33/00* (2013.01); *E21B 33/062* (2013.01); *E21B 33/072* (2013.01); *E21B 33/06* (2013.01)
USPC ..... 251/1.2; 251/1.1; 251/1.3

(58) Field of Classification Search
USPC ..... 251/1.1, 1.2, 1.3; 166/85.4, 86.1, 86.2
See application file for complete search history.

(56) References Cited

U.S. PATENT DOCUMENTS

| | | | | | |
|---|---|---|---|---|---|
| 2,609,836 | A | * | 9/1952 | Knox | 277/327 |
| 3,572,628 | A | * | 3/1971 | Jones | 251/1.2 |
| 3,897,040 | A | * | 7/1975 | Le Rouax | 251/1.2 |
| 3,897,071 | A | * | 7/1975 | Le Rouax | 277/325 |
| 3,915,426 | A | * | 10/1975 | LeRouax | 251/1.1 |
| 3,917,293 | A | * | 11/1975 | Lewis et al. | 277/327 |
| 4,332,367 | A | * | 6/1982 | Nelson | 251/1.3 |
| 4,444,404 | A | * | 4/1984 | Parks, Jr. | 277/325 |
| 4,550,895 | A | * | 11/1985 | Shaffer | 251/1.3 |
| 4,770,387 | A | * | 9/1988 | Granger | 251/1.3 |
| 4,930,745 | A | * | 6/1990 | Granger et al. | 277/325 |
| 5,011,110 | A | * | 4/1991 | Le | 251/1.1 |
| 5,044,603 | A | * | 9/1991 | Granger et al. | 277/325 |
| 5,064,164 | A | * | 11/1991 | Le | 251/1.1 |
| 5,575,451 | A | * | 11/1996 | Colvin et al. | 251/1.3 |
| 6,089,526 | A | * | 7/2000 | Olson | 251/1.3 |

* cited by examiner

*Primary Examiner* — John K Fristoe, Jr.
*Assistant Examiner* — Umashankar Venkatesan
(74) *Attorney, Agent, or Firm* — Winstead PC

(57) ABSTRACT

The present disclosure relates to seals and sealing arrangements, especially those used in wireline valves. The seal comprises an elastomeric seal body with a sealing surface, a plurality of generally planar inserts embedded within the elastomeric seal body adjacent the sealing surface, and having elastomeric seal material disposed between the plurality of generally planar inserts. The generally planar inserts may have a slightly wedge shape and may be embedded into the elastomeric seal body in a generally fan-shaped orientation. They may be orientated such that upon contacting a substantially tubular shaped body to be sealed around and the subsequent deformation of the seal body about said substantially tubular shaped body, the plurality of generally planar inserts become orientated such that they extend radially from the substantially tubular shaped body.

18 Claims, 5 Drawing Sheets

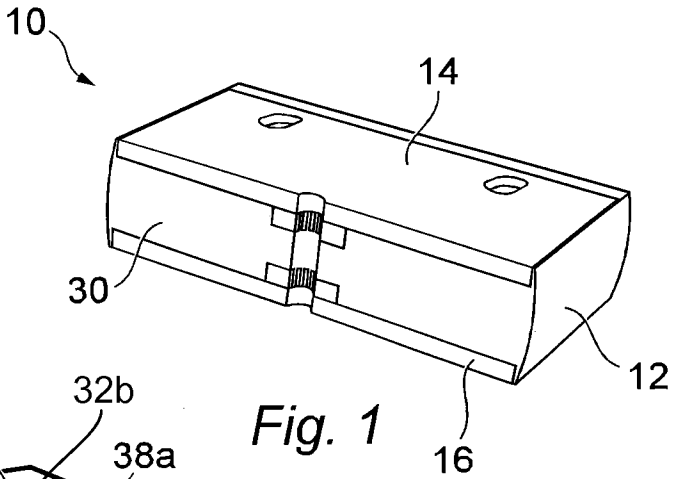
Fig. 1
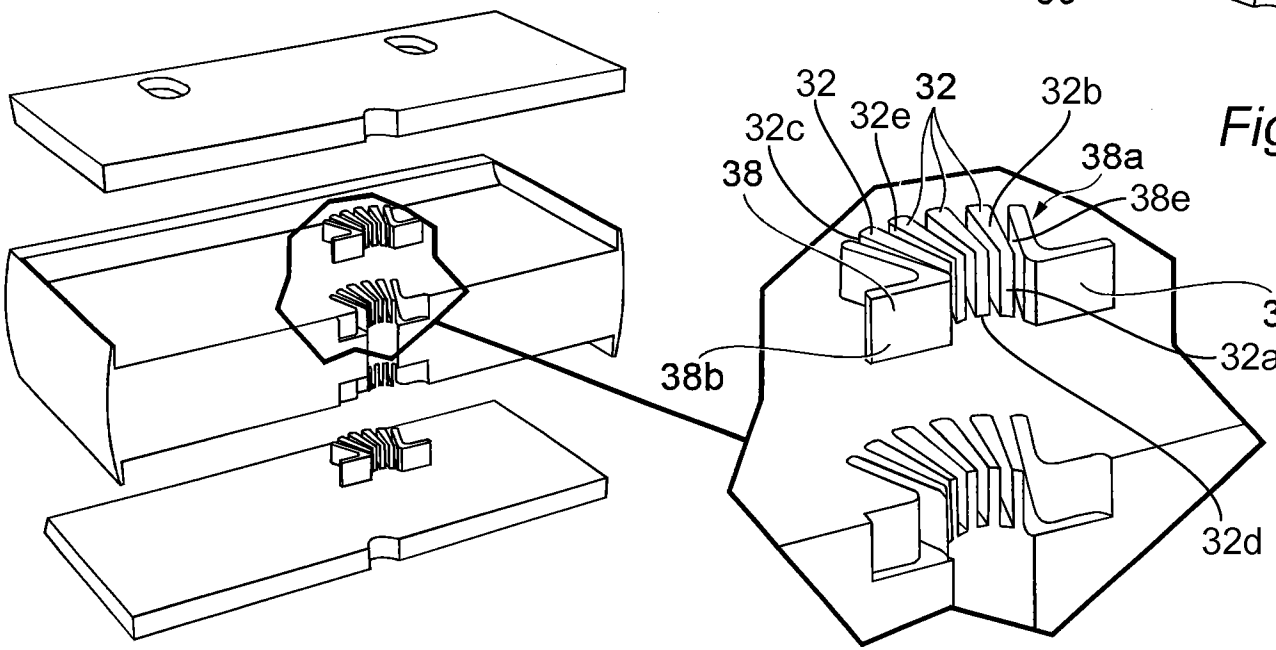
Fig. 3
Fig. 2

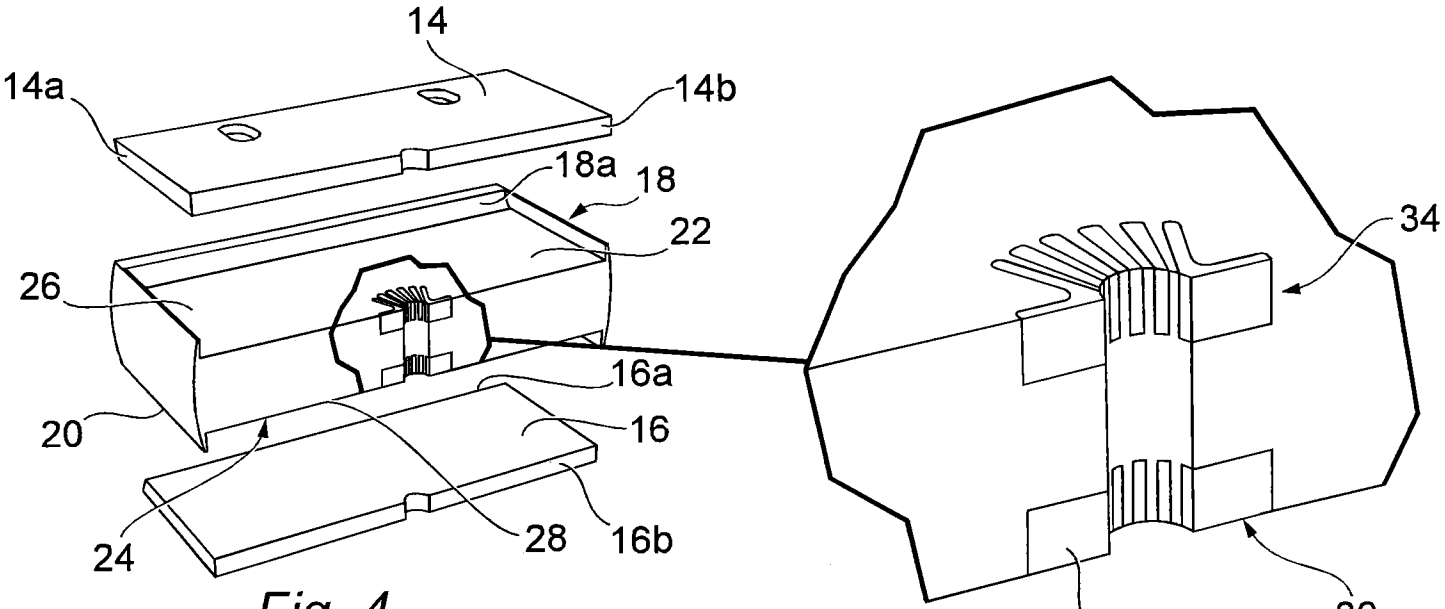
Fig. 5
Fig. 4
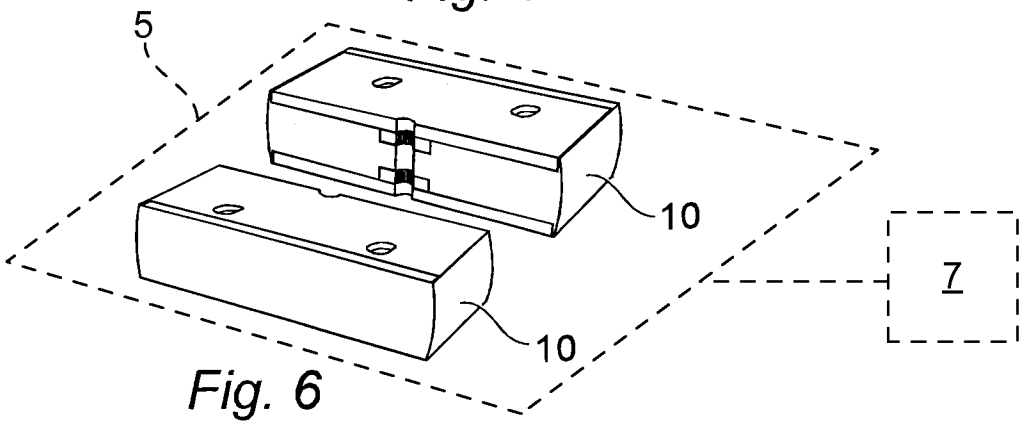
Fig. 6

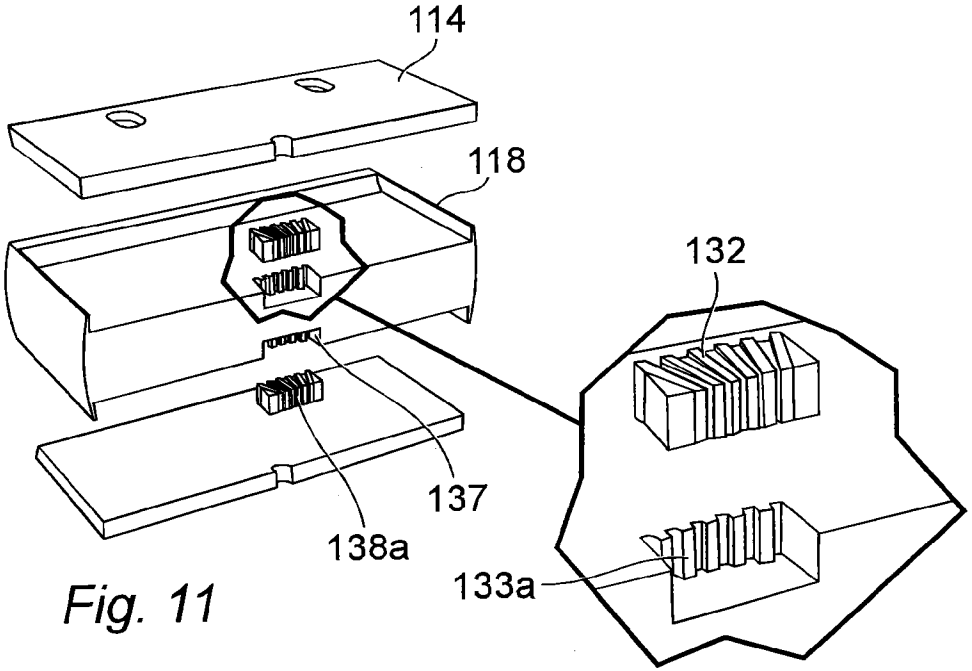
Fig. 11
Fig. 12
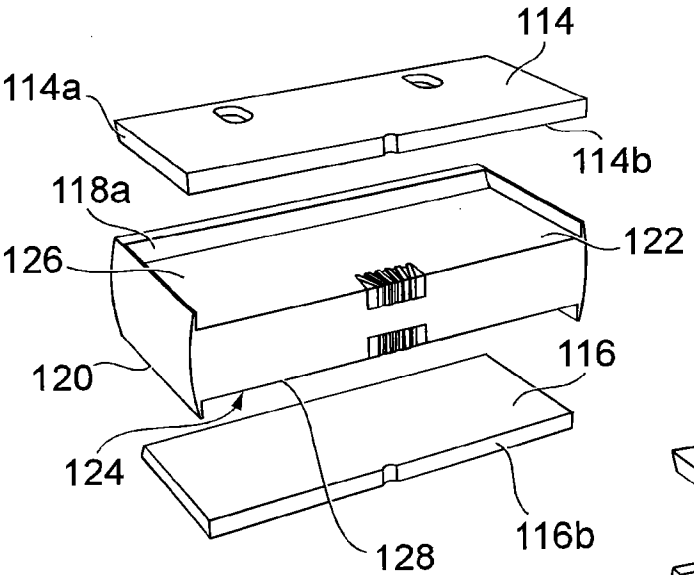
Fig. 13
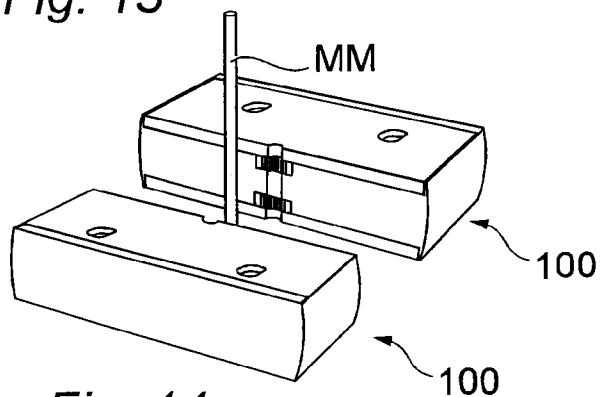
Fig. 14

SEAL

FIELD OF THE INVENTION

The present invention relates to seals and sealing arrangements, especially those used in wireline valves.

BACKGROUND TO THE INVENTION

Seals prevent or mitigate leakage of one fluid into another. They may be selectively applied i.e. a flow may be allowed until a certain condition is reached and it is desirable for such fluid flow to be halted.

In a wireline well intervention environment, one application of such seals and sealing arrangements is wireline valves. Wireline valves or "WLVs" are backup valves used on wellbores when wireline is present in the event of wireline based intervention in the wellbore.

Wellbores frequently have highly flammable fluids at elevated temperatures and pressures within them. In the event of a mechanical problem on the wireline, such as stranded wire, the WLVs may be closed around the line to seal the wellbore allowing remedial work to be performed on the section of line above the valve.

Such wireline valves may have to seal a well for a prolonged period of time, typically more than 12 hours, until such times as the wireline and associated equipment can be repaired or replaced, the wellbore is permanently sealed or some other intervention made.

There are two general types of wireline valve rams: the line sized and shear/seal ram types.

Line sized rams, be they multi- or specific line size configuration, enable the wireline valve to close around static cable when activated. The rams contain rubber elements which, when actuated by the hydraulic actuators, apply such rubber pressure around the cable that an effective seal is created. Combined with a second set of rams, and standard viscous grease injection into the intermediate void, an effective well barrier is created through the application of rubber pressure around the cable and grease filling the intermediate voids inside the cable.

Shear/Seal type rams combine a cutting element at the front of the rams with blind seals to create an effective well barrier after the line has been cut and dropped.

Ram wireline valves typically have two gate-like members which, in a normal operating position, are positioned either side of a central bore of a wireline valve and upon actuation are forced together to prevent fluid flow.

The seals of a wireline valve may have to withstand the elevated temperatures and pressures of the wellbore fluid.

Rubber or some other elastomeric materials are often optimal sealing materials, as their resilience and imperviousness may produce good sealing arrangements. However, they may not be best suited to the high temperatures and pressures, and the seals may yield and flow and eventually fail if subjected to such conditions for extended periods.

The seals of either type will often be reinforced by attaching an elastomeric material to a metal reinforcing plate, either on one side, or more typically, by sandwiching the elastomeric material between two metal plates.

Typically, the wireline valve will have a wireline, rod or pipe suspended through it, and this wireline, rod or pipe may be attached to downhole tools or monitoring equipment. The wireline valve seals are usually adapted such that upon activation, a tight seal is formed around these wirelines, rods or pipes but they do not sever them nor is a good seal prevented by their presence.

In a wireline valve ram, the mating seal faces of the metal plates will usually include complementary channels positioned parallel to the wireline (for example) such that when the blowout preventer is activated, the channels form bores in the adjoined metal plates that the wireline is encased within. The elastomeric seal bodies will initially have a planar mating seal side face and the elasticity of the material allows it to be shaped around a wireline without severing it. The steel plates, being rigid, require the channels to be cut in them or it may either prevent a good seal forming or may damage/sever the wireline.

The elastomeric material immediately surrounding the wireline may be subject to the direct pressure and potentially elevated temperature from the fluid in the wellbore i.e. the steel reinforcing plates may not wholly cover that section of material. The elastomeric material may then be prone to flow or quasi-liquefy about the wireline and thereby eventually breaking the seal after sufficient exposure time.

The wireline valve rams and associated inner seals are designed such that when sealing under well pressure conditions the rams are energised by well pressure rather than hydraulic actuators. The rams have an amount of running clearance between the actuator and ram body which enables the rams to move independent of the actuator, typically about ⅛" linear movement. Furthermore, the inner seals have a portion at the back where rubber protrudes beyond the supporting plates in a backwards direction, ensuring that the pressure face between ram body and inner seal is made up wholly of rubber. This ensures that the ram is able to maintain rubber pressure even in the event of rubber flow/loss over the cable interface as the ram will continually move to compensate for lost rubber volume. Thus inner seals can accommodate a certain amount of rubber loss without loss of seal integrity. Restricting this loss of rubber critical in the design of inner seals.

SUMMARY OF THE INVENTION

According to a first aspect of the present invention there is provided a seal comprising an elastomeric seal body with a sealing surface, a plurality of generally planar inserts embedded within the elastomeric seal body adjacent the sealing surface, and having elastomeric seal material disposed between the plurality of generally planar inserts.

The elastomeric seal body may be of a generally cuboidal or toroidal shape.

By "generally planar", it will be understood that this definition also includes generally wedge-shaped or prism-shaped inserts having a generally large ratio of facial dimension to mean thickness.

The generally planar inserts may be metallic, and may be copper alloys such as brass or aluminium bronze.

The generally planar inserts may have a slightly wedge shape, expanding from a first thickness deployed immediately adjacent the sealing surface, to a second thickness at the distal end thereof. The second thickness may be less than twice the first thickness.

The thickness of elastomeric material disposed between adjacent generally planar inserts may be equal to or less than the second thickness of the generally planar inserts, and may be equal to or less than the first thickness of the generally planar inserts. The thickness may be equal to or less than 2 mm, and may be equal to or less than 1 mm.

A plurality of the generally planar inserts may be embedded into the elastomeric seal body in a generally fan-shaped orientation. They may be orientated such that upon contacting a substantially tubular shaped body to be sealed around and the subsequent deformation of the seal body about said substantially tubular shaped body, the plurality of generally planar inserts become orientated such that they extend radially from the substantially tubular shaped body.

First edges of the generally planar inserts at the first thickness may be exposed i.e. they are not covered by isometric material. Second edges of the generally planar inserts, being perpendicularly adjacent the first edges may also be exposed i.e. they are not covered by isometric material. In use, both first edges and second edges may be covered by, for example, a substantially tubular shaped body to be sealed and reinforcing plates respectively.

The seal body may have a first arrangement of a plurality of generally planar inserts adjacent the sealing surface and a first surface of the seal body, the first surface being adjacent and substantially perpendicular to the sealing surface, and a second arrangement of a plurality of generally planar inserts adjacent the sealing surface and a second surface of the seal body, the second surface also being adjacent and substantially perpendicular to the sealing surface. The first and second surfaces may be upper and lower surfaces of the seal body.

There may be a discrete thickness of seal body between the innermost extents of the first and second arrangements. Such extents may be defined by fourth edges 32*d* (FIG. 3) of the generally planar reinforcing elements, being the opposite edges to the second edges.

According to a second aspect of the present invention there is provided a wireline valve including at least one seal according to the first aspect.

According to a third aspect of the present invention there is provided a blow-out preventer including at least one seal according to the first aspect.

BRIEF DESCRIPTION OF THE DRAWINGS

Embodiments of the present invention will now be described, by way of example only, with reference to the following drawings, in which:

FIG. 1 is a perspective view of a first embodiment seal according to a first aspect of the present invention;

FIG. 2 is an exploded perspective view of the seal of FIG. 1;

FIG. 3 is a detail perspective view of FIG. 2;

FIG. 4 is a further exploded perspective view of the seal of FIG. 1;

FIG. 5 is a detail perspective view of FIG. 4;

FIG. 6 is a perspective view of two seals according to an first aspect of the present invention;

FIG. 11 is a further exploded perspective view of the seal of FIG. 8;

FIG. 12 is a detail perspective view of FIG. 11;

FIG. 13 is a further exploded perspective view of the seal of FIG. 8; and FIG. 14 is a perspective view of two second embodiment seals according to a first aspect of the present invention.

Figure 7B:
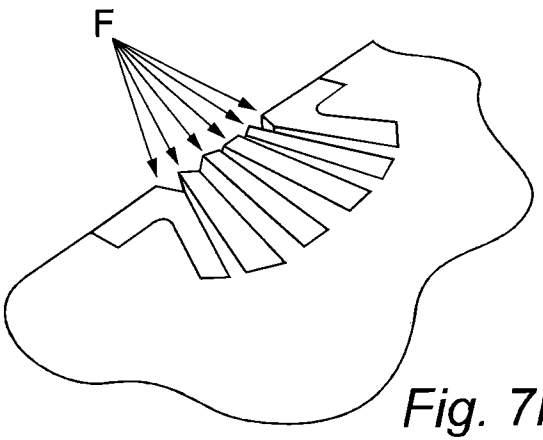
FIG. 7*a*-7*d* are perspective detail views of the deformation mechanism of the seal of FIG. 1.

Referring to the drawings and initially to FIG. 1, a seal 10 is depicted comprising a seal body 12, an upper reinforcing steel plate 14 and a lower reinforcing steel plate 16. The seal body 12 is formed from an elastomeric substance, in this case rubber, and is sandwiched between the upper reinforcing steel plate 14 and the lower reinforcing steel plate 16.

The seal body 12 is substantially a rectangular cuboid shape. An upper lip 18 extends from its upper surface 22, projecting from three of the four edges of the upper surface 22. A lower lip 20 also extends from the lower surface 24, again projecting from three of the four edges of the lower surface 24. The upper and lower lips 18,20 define upper and lower plate housings 26,28 into which the upper reinforcing steel plate 14 and the lower reinforcing steel plate 16 are received. The lips 18,20 provide sealing surfaces over the plates 14,16 in order to facilitate seal integrity.

The plates 14,16 are largely identical. They are substantially rectangular. A first edge 14*a*,16*a* is at a slight angle and not perpendicular to upper and lower surfaces of the plates 14,16. These edges 14*a*,16*a* abut correspondingly angled surfaces 18*a*,20*a* of the lips 18,20.

The seal body 12 has a seal face 30. The seal face 30 extends between the upper surface 22 and the lower surface 24, between the edges of the upper and lower surface 22,24 which do not have a lip 18,20 adjoined.

The seal face 30 is substantially planar. At an approximate mid-point of the greater dimension of the seal face 30, adjacent the upper and lower surfaces 22,24 are provided upper and lower reinforcing arrangements 34,36. The reinforcing arrangements 34,36 each comprise a plurality of substantially planar but slightly wedge-shaped brass inserts 32 embedded within the seal body 12. As well as brass, other suitable alloys may be employed, such as aluminium bronze.

The brass inserts 32 have a high ratio of length and width to thickness i.e. they are relatively thin planar inserts. They are also slightly wedge shaped i.e. they expand from a first thickness $T_1$, first edge 32*a*, of about 0.5 mm to a second thickness $T_2$, third edge 32*c*, of about 2.0 mm. The brass inserts 32, although embedded, are also exposed along two adjacent edges: a first edge 32*a* (which has a uniform thickness of the first thickness $T_1$) and a second edge 32*b* (which expands from first thickness $T_1$ to second thickness $T_2$). The first edge 32*a* is exposed on the seal face 30, and the second edge 32*b* is exposed on either the upper surface 22 or the lower surface 24, depending on whether the insert belongs to the upper reinforcing arrangement 34 or the lower reinforcing arrangement 36 respectively.

Between adjacent brass inserts 32 a relatively thin layer of seal body 12 isometric material is disposed. This layer is about 1 mm in thickness, albeit there is some variation in the exact thickness, due to the inserts 32 being wedge shaped and the deformation mechanism described below.

The brass inserts 32 are disposed in a generally fan-shaped orientation, and on either side of the plurality of brass inserts 32 in each of the upper and lower reinforcing arrangements 34,36 are provided end inserts 38.

The end inserts 38 are slightly acute L-shapes i.e. they comprise a first plate section 38*a* adjoined at an angle less than 90 degrees to a second plate section 38*b*. The second plate section 38*b* is about the same length as brass inserts 38, and the first plate section 38*b* having a shorter length. The join between first plate section 38*a* and second plate sections 38*b* is chamfered on the inner edge. There is also a inwardly curved exterior edge 38*c* orientated towards the centre of the upper and lower reinforcing arrangements 34,36 and therefore the approximate mid-point of the greater dimension of the seal face 30. The particular shape and orientation of the end inserts 38 including the size and relative angle of first plate section 38 and second plate section 38*b* may be different depending on the operating parameters including the wireline size. The end inserts 38 are orientated such that both first plate section 38*a* and second plate sections 38*b* project away from the centres of the upper and lower reinforcing arrangements 34,36 and therefore the approximate mid-point of the greater dimension of the seal face 30.

Figure 7D:
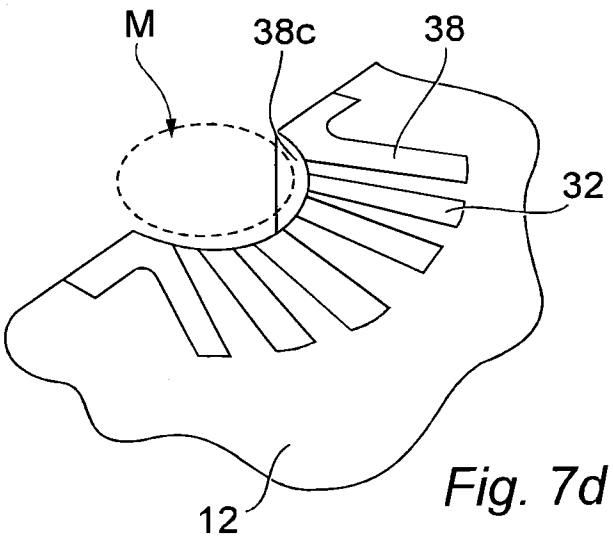

Turning to FIGS. 7*a*-7*d*, a sequence showing the deformation mechanism of the upper reinforcing arrangement 34 is depicted. FIG. 7*d* shows the initial condition and how the inserts 32,38 are initially orientated within the seal body 12. It will be noted that they are orientated in a general fan shape, but are not yet in contact with the tubular member M suspended between two seals 10.

Figure 7A:
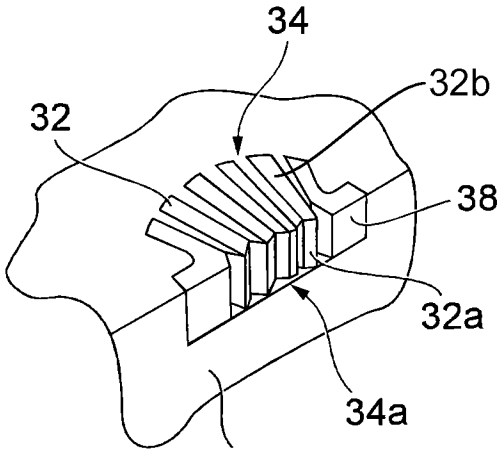

FIGS. 7*a* and 7*b* depict the reinforcing arrangement 34 when fully closed in the absence of a tubular member M. In this case the seal is required to close in a blind fashion and the reinforcing arrangement 34 is required to fully deform to close off the circular line-sized cut in the reinforcing plates 14 and 16. The rubber between the brass inserts 32 allows them to move independently and in full compliance with the body rubber, however the general fan shape arrangement is maintained. The mating sealing face of the brass inserts 32 forms a concertina shaped face 34*a*, which under actuation pressure is filled with body rubber forming a pressure tight seal against a corresponding second and opposing seal 10 in a wireline valve 5 disposed for example in a blow-out preventer ("BOP") 7 (see, e.g., FIG. 6).

Figure 7C:
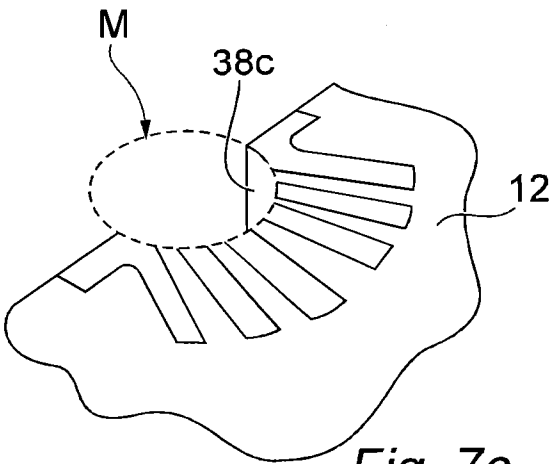
Figure 8:
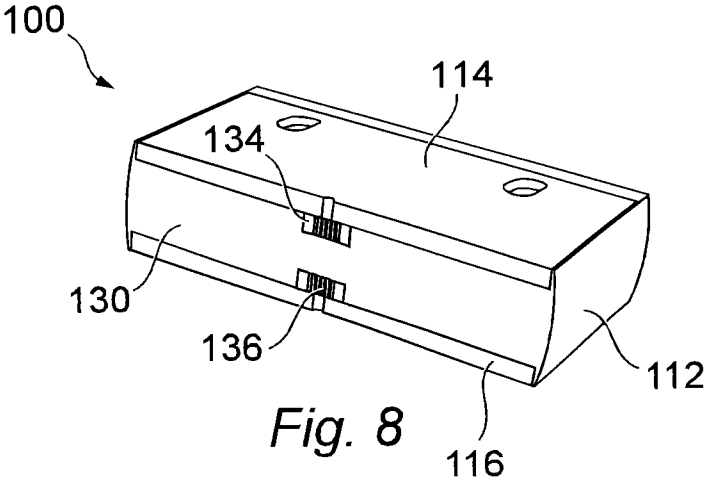
FIG. 8 is a perspective view of a second embodiment seal according to a first aspect of the present invention.
Figure 9:
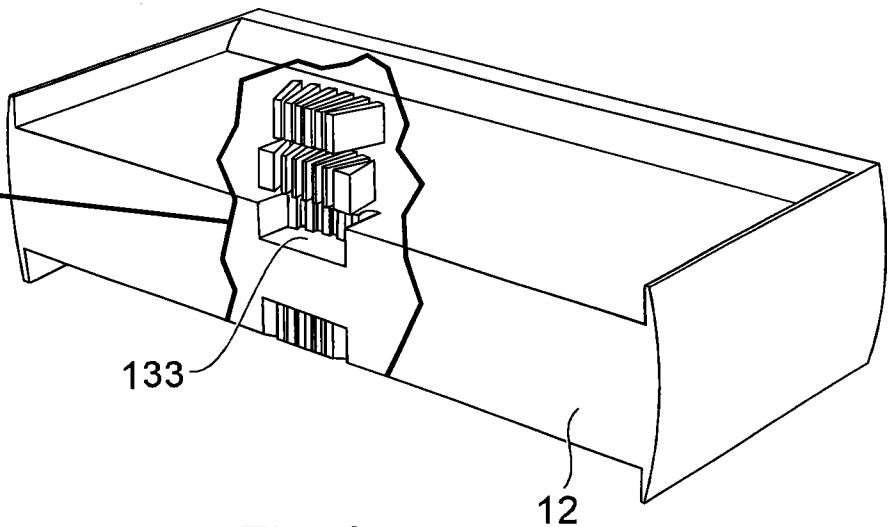
FIG. 9 is an exploded perspective view of the seal of FIG. 8.
Figure 10:
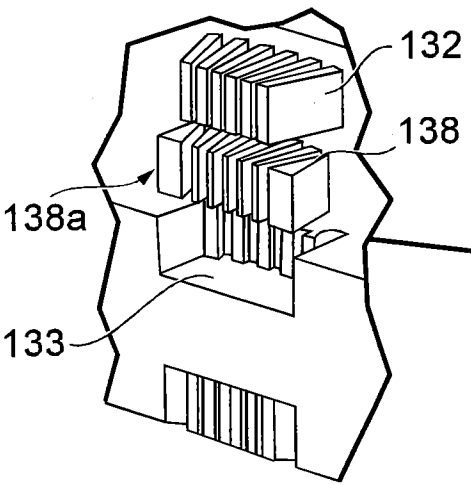
FIG. 10 is a detail perspective view of FIG. 9.

FIG. 7*c* shows the fully sealed position in the presence of a tubular member M that is suspended between two seals 10, which may be any size up to and including the maximum line size made possible by the cutting of line slots in the upper and lower reinforcing plates 16 and 14 and which will usually be a metal. A reaction force F acts against the mating face 34*a* forcing it to deform around the tubular member M. The mating face 34*a* will deform into a semicircular shape, matching the shape of the tubular member M.

The first edges 32*a* of the inserts 32 are in metal-to-metal contact with the tubular member M. Moreover, the inwardly curved exterior edge 38*c* also abuts the tubular member M in metal-to-metal contact. The inserts 32, 38 form a larger and more regular fan-shape in this orientation.

FIG. 5 depicts the flow of the elastomeric material (rubber) from the seal body 12 is restricted in this orientation. A tendency for the rubber to flow from the seal body radially outwardly of the upper and lower reinforcing arrangements 34,36 towards them, causes the inserts 32,38 to be forced towards the tubular member M maintaining a good seal. It will be noted that the slight wedge shape of the inserts 32 mitigates any tendency for them to shear out of embedment within the rubber, and also for the rubber to flow out between the inserts 32,38.

The relatively large contact area between the rubber and the side faces 32*e*, 38*e* (FIG. 3) of the inserts 32, 38 mitigates this shear as well. An effect akin to aerodynamic boundary layer effect may aid in mitigating rubber flowing from the intermediate spaces between inserts 32, 38.

Rubber flow from between the upper and lower reinforcing arrangements 34,36 coaxial to the tubular member M is also mitigated by the presence and orientation of the upper and lower reinforcing arrangements 34,36.

The plates 14,16 on the second edges 14*b*,16*b* have semicircular channels 14*c*,16*c* formed in them. These semicircular channels 14*c*,16*c* are formed at the approximate midpoint of the second edges 14*b*,16*b*, and are located both adjacent the reinforcing arrangements 34,36 and, in use, the tubular member M. It will be appreciated that the plates 14,16 have little resilience, and hence the semicircular channels 14*c*,16*c* will need to be of equal or slightly larger diameter than tubular member M to mitigate damage being caused to the tubular member M when the seal is forced into contact with it in a blowout situation. There may therefore be a slight overlap of reinforcing arrangements 34,36 over the steel plates 14,16 and the reinforcing arrangements 34,36 not being provided with additional reinforcement at these slight overlaps. The design of the reinforcing arrangements 34,36 mitigates the presence of these overlaps and the tendency of rubber to be forced outwardly from the seal body 12 between the overlap and the tubular member M, as may be prevalent in prior art designs.

The wedge shaped nature of the inserts 32 also restricts rubber loss through the circular cut out in the reinforcing steel plates 12 and 14. When the seal is required to close blind as in FIGS. 7*a* and 7*b*, the inserts 32 are required to move relatively large distances towards the centre. In doing so, they will expose an increasing extrusion gap to the cut out through which rubber loss can occur rapidly, this occurs over the back end of the inserts. The wedge shape of the inserts 32 ensures that the rate of increase of area is kept to a minimum as the inserts 32 move inwardly to create a seal.

The reinforcing plates 16 and 14 have release agent applied locally in the area immediately adjacent to, and in contact with, the inserts 32 to ensure that the inserts are free to move with the body rubber and are not restricted by being bonded to the reinforcing plates. The freedom for the inserts 32 to move relative to the reinforcing plates 16 and 14 is critical for the function of the seal.

A second embodiment seal 100 is shown in FIGS. 8-14. Elements identical or largely similar to those described in the first embodiment are numbered similarly, albeit prefixed with a "1", apart from as described below.

The main difference between first and second embodiments is the specific design of the reinforcing arrangements.

In the second embodiment, upper and lower reinforcing arrangements 134,136 comprise a plurality of brass inserts 132. They are similarly planar, but are not wedge-shaped, they are more regular plates.

The seal body 112 has upper and lower notches 133,137 formed in it; upper notch 133 is adjacent the seal face 130 and the upper surface 122; whereas lower notch 137 is adjacent the seal face 130 and the lower surface 124. The notches 133, 137 have a ribbed rear surface 133*a*, 137*a* i.e. the surface that is in a plane substantially parallel to the plane of the seal face 130. The ribbing corresponds in dimension to the thickness of the brass inserts 132.

The plurality of brass inserts 132 are layered in between wedge shaped rubber inserts 138, such that the planer brass inserts 132 are arranged in a fan-shape. At either side of this arrangement are provided triangular prism shaped inserts 138*a*, which impart a substantially rectangular cuboid shape to the arrangement. The brass inserts 132 are slightly longer than the rubber inserts 138,138*a*, thus provide a cooperating ribbing surface which cooperates with ribbed rear surfaces 133*a*,137*a*.

The operation and deformation mechanism of the second embodiment is largely identical to that of the first embodiment described above.

Modifications and improvements can be made to the embodiments herein before described without departing from the scope of the invention.

The invention claimed is:

1. A seal comprising an elastomeric seal body with a first planar surface, a second planar surface substantially parallel to the first planar surface, and a sealing surface adjacent to and substantially perpendicular to the first and second planar surfaces, a plurality of generally planar inserts having planar side faces that are arranged substantially perpendicular to the first and second planar surfaces, the planar side faces having a length dimension and a width dimension, and wherein the length and width dimensions of the planar side faces are both greater than a thickness dimension of the generally planar inserts, wherein the plurality of generally planar inserts are arranged in a first arrangement of a plurality of generally planar inserts embedded within the elastomeric seal body adjacent the sealing surface and the first planar surface of the seal body, and a second arrangement of a plurality of generally planar inserts embedded within the elastomeric seal body adjacent the sealing surface and the second planar surface of the seal body, and having elastomeric seal material disposed between the planar side faces of the adjacent generally planar inserts in each of the first and second arrangements, wherein each of the generally planar inserts in each of the first and second arrangements comprises a first edge exposed at the sealing surface, wherein the generally planar inserts in the first arrangement are spaced apart from the generally planar inserts in the second arrangement.

2. A seal according to claim 1 wherein the plurality of generally planar inserts are metallic.

3. A seal according to claim 1 wherein the plurality of generally planar inserts are formed from metals selected from the group consisting of copper alloys, brass and aluminum bronze.

4. A seal according to claim 1 wherein the plurality of generally planar inserts in the plurality of generally planar inserts have a wedge shape, expanding from a first thickness deployed immediately adjacent at the first edge exposed at the sealing surface, to a second thickness at a distal end thereof.

5. A seal according to claim 4 wherein the second thickness is less than twice the first thickness.

6. A seal according to claim 4 wherein the thickness of elastomeric material disposed between adjacent generally planar inserts in the plurality of generally planar inserts is equal to or less than the second thickness of the generally planar inserts.

7. A seal according to claim 4 wherein the thickness of elastomeric material disposed between adjacent generally planar inserts in the plurality of generally planar inserts is equal to or less than the first thickness of the generally planar inserts.

8. A seal according to claim 1 wherein the plurality of the generally planar inserts are embedded into the elastomeric seal body in a generally fan-shaped orientation.

9. A seal according to claim 1 wherein each generally planar insert of the plurality of generally planar inserts comprises a second edge, being perpendicularly adjacent the first edge.

10. A wireline valve including at least one seal according to claim 1.

11. A blow-out preventer including at least one seal according to claim 1.

12. A seal according to claim 1, wherein an edge of each generally planar insert in the first arrangement of a plurality of generally planar inserts is exposed at the first planar surface, and wherein an edge of each generally planar insert in the second arrangement of a plurality of generally planar inserts is exposed at the second planar surface.

13. A seal according to claim 1, wherein the first planar surface comprises an upper surface of the seal body, and the second planar surface comprises a lower surface of the seal body, and wherein the generally planar inserts in the first arrangement of a plurality of generally planar inserts are spaced apart from the generally planar inserts in the second arrangement of a plurality of generally planar inserts by the elastomeric material of the seal body.

14. A seal according to claim 13, wherein the first arrangement of a plurality of generally planar inserts is disposed in a first notch at the upper surface of the seal body, and wherein the second arrangement of a plurality of generally planar inserts is disposed in a second notch at the lower surface of the seal body.

15. A seal according to claim 13, wherein the first and the second arrangements of a plurality of generally planar inserts are movable independently.

16. A seal according to claim 13, wherein the generally planar inserts in the first and second arrangements of a plurality of generally planar inserts each have a second edge which is perpendicular to and adjacent to the first edge of the generally planar inserts exposed at the sealing surface, and wherein each second edge of each generally planar insert in the first arrangement of a plurality of generally planar inserts is exposed at the upper surface of the seal body, and wherein each second edge of each generally planar insert in the second arrangement of a plurality of generally planar inserts is exposed at the lower surface of the seal body.

17. A seal according to claim 16, wherein the generally planar inserts are freely movable relative to one another.

18. A seal according to claim 1, wherein each of the first and second arrangements of a plurality of generally planar inserts embedded within the elastomeric material of the seal body includes first and second end inserts arranged at each end of the first and second arrangement, each of the end inserts comprising a first plate section adjoined at an angle of less than 90 degrees and greater than 0 degrees to a second plate section.

* * * * *